US005252237A

United States Patent [19]

Andress, Jr. et al.

[11] Patent Number: 5,252,237

[45] Date of Patent: Oct. 12, 1993

[54] COMPLEX ALKOXY BORATES OF ALKYLATED PHENOLS AS LUBRICANT STABILIZERS

[75] Inventors: Harry J. Andress, Jr., Wenonah; Henry Ashjian, East Brunswick; William F. Olszewski, Cherry Hill; Robert E. Ernhoffer, Sewell, all of N.J.

[73] Assignee: Mobil Oil Corporation, Fairfax, Va.

[21] Appl. No.: 923,655

[22] Filed: Aug. 3, 1992

[51] Int. Cl.[5] ..... C10M 139/00

[52] U.S. Cl. ..... 252/49.6; 252/32.7 E; 252/39; 568/5

[58] Field of Search ..... 252/49.6; 568/5

[56] References Cited

U.S. PATENT DOCUMENTS

| | | | |
|---|---|---|---|
| 3,359,298 | 12/1967 | Hunter et al. | 252/49.6 |
| 4,440,656 | 4/1984 | Horodysky | 252/49.6 |
| 4,530,770 | 7/1985 | Braid | 252/49.6 |
| 4,655,948 | 4/1987 | Doner et al. | 252/49.6 |
| 4,701,274 | 10/1987 | Croudace et al. | 252/49.6 |
| 4,781,850 | 11/1988 | Doner et al. | 252/49.6 |
| 4,985,157 | 1/1991 | Farng et al. | 252/49.6 |

*Primary Examiner*—Ellen M. McAvoy
*Attorney, Agent, or Firm*—Alexander J. McKillop; Malcolm D. Keen; Howard M. Flournoy

[57] ABSTRACT

Alkoxy borates of alkylated phenols have been found to be effective cleanliness agents for lubricants and additives for improving the dropping point of greases.

19 Claims, No Drawings

COMPLEX ALKOXY BORATES OF ALKYLATED PHENOLS AS LUBRICANT STABILIZERS

BACKGROUND OF THE INVENTION

1. Field of the Invention

This application is directed to additive products which are effective for stabilizing oil and grease compositions and to oil and grease compositions containing same. The subject products are derived from the reaction of alkylated phenols with alcohols and suitable boronating substances.

2. Description of Related Art

Borate esters of hindered phenols have been utilized in the prior fuel and lubricant art. For example, U.S. Pat. No. RE32,295 discloses that borate esters of hindered phenols are hydrolytically stable and possess antioxidant properties as fuel or lubricant additives. U.S. Pat. No. 4,507,216 further discloses that hindered phenyl esters of cyclic borates are useful in reducing the friction resulting when two surfaces are in sliding or rubbing contact.

U.S. Pat. No.4,698,169 is directed to products made by reacting an alkenyl succinic compound with an arylamine, an alkanolamine, a monoaminomethane, a hindered alcohol and borated reaction products thereof which provide dispersant and antioxidant characteristics to lubricant compositions.

U.S. Pat. No. 4,389,322 discloses the use of borated adducts of ethoxylated amides as a component of lubricating oils or greases.

U.S. Pat. No. 4,328,113 discloses that borated amines as friction reducers in lubricants or lubricating oils. However, no art is known to Applicants which discloses the complex alkoxy borates of alkylated phenols as disclosed herein.

BRIEF SUMMARY OF THE INVENTION

This invention is directed to complex hydrocarbyloxy borates of hydrocarbyl phenols as lubricant stabilizers. This invention is more particularly directed to alkoxy borates of alkylated phenols as effective stabilizers for gear oil and grease compositions. This invention is further directed to lubricant and to grease formulations having increased dropping points containing the additive products of reaction in accordance with the invention.

An object of this invention is to provide improved lubricant compositions and greases having superior stability under diverse service conditions and also to provide greases with increased dropping points.

DESCRIPTION OF PREFERRED EMBODIMENTS

In general, alkylated monohydric and/polyhydric phenols are reacted with an alcohol and a boronating agent to give compounds of the following structure:

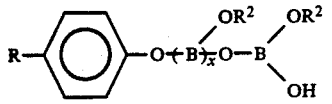

Suitable hydrocarbyl phenols may contain from 1 to about 300 carbon atoms or more, i.e., up to about 10,000 carbon atoms, in the hydrocarbyl group (R), preferred are $C_2$ to about $C_{32}$, and the phenols may be monohydric or polyhydric and X is 1 to about 20 and preferably 2 to 8. They may be obtained commercially or prepared by any convenient means known to the art. Highly preferred are, for example, monohydric alkyl phenols such as dodecylphenol, and polyhydric such as catechol, hydroquinone and resorcinol and their substituted counterparts such as tetradecyl of ditetradecyl -catechol, -hydroquinone or -resorcinol.

Suitable alcohols include any hydrocarbyl substance having at least one free hydroxy group, usually having from 2 to about 36 carbons. Preferred are alcohols such as butanol, isodecanol, isotridecanol and the like.

The boronating (or borating) substance may be a boron compound selected generally from the group consisting of boric acid, boric oxide, metaborate or an alkyl borate of the formula:

$$, (R^2O)_yB(OH)_z$$

wherein y is 1 to 3, z is 0 to 2, their sum being 3 , and $R^2$ is an alkyl group containing from 1 to about 6 carbon atoms.

When a solvent is desired, any suitable hydrocarbon solvent such as toluene or a xylene may be used.

Conditions for the above reactions may vary widely depending upon specific reactants, the presence or absence of a solvent and the like. Any suitable set of reaction conditions known to the art may be used. Generally, stoichiometric quantities of reactants are used. However, equimolar, more than molar or less than molar amounts may be used. The reaction temperature may vary from ambient to about 250° C. or reflux, the pressure may vary from ambient or autogenous to about 100 psi and the molar ratio of reactants preferably varies from about 1 mole to about 10 moles. Often an excess of the boronating compound is used.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyalphaolefins such as polybutenes and hydrogenated polydecenes, polyglycols such as polypropylene glycol, polyethylene glycol, and synthetic esters such as the esters of dibasic carboxylic acids with monohydric alcohols such as di(2-ethylhexyl) sebacate and di(2-ethylhexyl) adipate and the hindered poloyol esters, especially the esters of trimethylol propane (TMP), pentaerythritol or dipentaerythritol with monohydric alcohols, e.g., trimethylpropane esters, neopentyl and pentaerythritol esters. Ester-based lubricants are highly suitable.

The following examples present illustrations of the invention. They are illustrative only, and are not meant to limit the invention.

EXAMPLE 1

A mixture of 285 g (1.09 mol) of dodecylphenol, 201 g (3.27 mols) boric acid, 240 g (3.27 mols) n-butanol and about 100 ml of toluene diluent was gradually refluxed to about 220° C. and held until the evolution of water ceased. The final product was obtained by topping under reduced pressure.

EXAMPLE 2

A mixture of 250 g (0.5 mol) of ditetradecyl catechol, 155 g (2.5 mols) boric acid, 185 g (2.5 mols) n-butanol and about 100 ml of toluene diluent was gradually refluxed to about 210° C. and held until the evolution of water ceased. The final product was obtained by topping under reduced pressure.

EXAMPLE 3

A mixture of 250 g (0.5 mol) of ditetradecyl resorcinol, 186 g (3.0 mols) boric acid, 222 g (3.0 mols) n-butanol and 100 ml of toluene diluent was refluxed to about 225° C. and until evolution of water ceased. The final product was obtained by topping under vacuum.

EXAMPLE 4

A mixture of 250 g (0.5 mol) of ditetradecyl hydroquinone, 205 g (3.3 mols) boric acid, 250 g (3.3 mols) n-butanol and 100 ml toluene diluent was refluxed to about 222° C. and until evolution of water ceased. The final product was obtained by topping under vacuum.

EXAMPLE 5

A mixture of 263 g (1.0 mol) of dodecylphenol, 434 g (7.0 mols) boric acid, 518 g (7.0 mols) n-butanol and 200 ml toluene diluent was refluxed to about 220° C. and until evolution of water ceased. The final product was obtained by topping under vacuum.

EXAMPLE 6

A mixture of 400 g (2.0 mols) of isotridecanol, 434 g (7.0 mols) boric acid, 518 g n-butanol and about 100 ml of toluene diluent was gradually refluxed to about 240° C. and held until the evolution of water ceased. The final product was obtained by topping under vacuum.

EVALUATION OF PRODUCTS

Products in accordance with the invention were evaluated in the L-60 Gear Oil Test and and grease formulations thereof were evaluated for dropping point performance.

The L-60 test is a laboratory performance test for automotive gear lubricants intended for API GL-5 service or those meeting the U.S. Military MIL-L-2105D specification. The test method is described in ASTM Special Technical Publication 512A. This method describes a test procedure for determining the deterioration of gear lubricants when subject to severe thermal oxidation conditions. The gear lubricant to be tested is placed in a heated gear box in which two spur gears and a test bearing are operating at a predetermined load in the presence of a copper catalyst. The temperature of test lubricant is maintained at 325° F. (163° C.) while bubbling 0.3 gal/hr (1.1 l/h) of air through the oil for a test duration of 50 hours.

Test lubricant properties which are measured include percent viscosity increase, pentane insolubles and toluene insolubles. These properties are mainly influenced by the quality of the base oil and not by the additives.

ASTM, in cooperation with SAE and API, is defining a new automotive gear oil specification designated PG-2 which includes the L-60 test a described above but with an additional varnish rating. At the conclusion of the test, the spur gears and bearing are rated for carbon/varnish as described in CRC Manuals 12 and 14. The numerical rating is 0–10 , with 10 being clean and free of carbon/varnish. A correlation has been established between these numerical ratings and lubricant service life in the field. The carbon/varnish obtained in the L-60 test is directly related to the nature of the additives present in the lubricant.

TABLE 1

L-60 Test Results
Additives were blended in a typical sulfur/phosphorus automotive gear oil.

| Additive | Conc., Wt % | Carbon/Varnish Rating |
|---|---|---|
| Base Gear Oil | 0.0 | 0.99 |
| Base Gear Oil + Ex. 2 | 1.0 | 9.08 |
| Base Gear Oil + Ex. 1 | 0.6 | 9.10 |
| Base Gear Oil + Ex. 5 | 0.5 | 9.30 |
| Base Gear Oil + Ex. 6 | 0.63 | 9.60 |

The above test data clearly demonstrate the effectiveness of the instant products of reaction as stabilizers for oils and greases.

The dropping points of the grease formulations were determined per ASTM D2265-78 .

TABLE 2

Dropping Point of Lubricating Grease
A.S.T.M. D-2265-78
Lithium'12-Hydroxystearate Grease

| Additive | Conc., Wt % | Dropping Point, °F. |
|---|---|---|
| Base Grease | 0.0 | 415 |
| Base Grease + Ex. 2 | 1.25 | 517 |

TABLE 2-continued

| Dropping Point of Lubricating Grease A.S.T.M. D-2265-78 Lithium 12-Hydroxystearate Grease | | |
|---|---|---|
| Additive | Conc., Wt % | Dropping Point, °F. |
| Base Grease + Ex. 5 | 2.0 | 542 |
| Base Grease Containing 1.5% of a Commercial Zinc Dithiophosphate | | |
| Base Grease | 0.0 | 415 |
| Base Grease + Ex. 2 | 1.0 | 603 |
| Base Grease + Ex. 5 | 0.75 | 603 |

It is clear from the data set forth in Table 2 that the dropping point of a grease will be increased if minor amounts of the additive product of reaction described herein is added to the grease formulation.

What is claimed is:

1. An improved lubricant composition comprising a major amount of an oil of lubricating vicosity or a grease prepared therefrom and containing a minor amount of from about 0.001 to about 10% by weight based on the total weight of the composition of a product of reaction prepared by reacting a hydrocarbyl or hydrocarbyloxy phenol with an alcohol and a boronating agent selected from the group consisting of boric acid, boric oxide, metaborate and an alkyl borate of the formula:

$$(R^2O)yB(OH)z$$

wherein y is 1 to 3, z is 0 to 2, their sum being 3, and $R^2$ is an alkyl group having from 1 to about 6 carbon atoms and wherein the reaction is carried out at temperatures varying from ambient to about 250° C. under pressure varying from ambient or autogenous for a time sufficient to obtain the desired additive product of reaction and wherein the molar ratios of the various reactants vary from equimolar to more than equimolar to less than equimolar.

2. The lubricant composition of claim 1 wherein said product comprises a mixture of borated compounds at least one of which has the following structure:

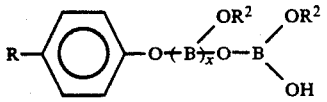

Wherein R is $C_1$ to about $C_{300}$ hydrocarbyl and optionally contains S, 0, N or mixtures thereof and X is 1 to about 20.

3. The composition of claim 1 wherein the reactants are dodecylphenol, boric acid and n-butanol.

4. The composition of claim 1 wherein the reactants are ditetradecyl catechol, boric acid and n-butanol.

5. The composition of claim 1 wherein the reactants are ditetradecyl resorcinol, boric acid and n-butanol.

6. The composition of claim 1 wherein the reactants are ditetradecyl hydroquinone, boric acid and n-butanol.

7. The composition of claim 1 wherein the lubricant is an oil of lubricating viscosity selected from the group consisting of (1) mineral oils, (2) synthetic oils, (3) or mixtures of mineral and synthetic oils or is (4) a grease prepared from any one of (1), (2) or (3).

8. The composition of claim 7 wherein the lubricant is a mineral oil.

9. The composition of claim 8 wherein the lubricant has utility as a gear oil.

10. An improved grease composition comprising a major proportion of (1) a grease, (2) from 0.001 to about 10% by weight of a means for increasing the dropping point of the grease composition comprising a reaction product made by reacting a hydrocarbyl or hydrocarbyloxy phenol with an alcohol and a boronating compound selected from the group consisting of boric acid, boric oxide, metaborate or a compound of the formula:

$$(R^2O)yB(OH)z$$

wherein x is 1 to 3, y is 0 to 2, their sum being 3, and $R^2$ is an alkyl group containing from 1 to about 6 carbon atoms, (3) a thickener containing at least about 15% of a 12 hydroxystearate thickener and (4) a compound containing both phosphorus and sulfur supplied by a zinc $C_3$ to $C_6$ alkyl phosphorodithioate compound.

11. The composition of claim 10 wherein said thickener is a lithium 12 hydroxystearate thickener.

12. A process of preparing a high temperature stabilizing additive product prepared by reacting a hydrocarbyl or hydrocarbyloxy phenol with an alcohol and a boronating agent selected from the group consisting of boric acid, boric oxide, metaborate and an alkyl borate of the formula:

$$(R^2O)yB(OH)z$$

wherein y is 1 to 3, z is 0 to 2, their sum being 3, and $R^2$ is an alkyl group having from 1 to about 6 carbon atoms and wherein the reaction is carried out at temperatures varying from ambient to about 250.C under pressure varying from ambient or autogenous for a time sufficient to obtain the desired additive product of reaction and wherein the molar ratios of the various reactants vary from equimolar to more than equimolar to less than equimolar.

13. The process of claim 12 wherein said additive product is prepared by a mixture cf borated compounds at least one of which has the following structure:

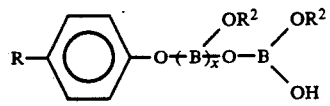

Wherein R is $C_1$ to about $C_{100}$ hydrocarbyl and optionally contains S, O, N or mixtures thereof and X is 1 to about 20.

14. A multifunctional high temperature stabilizing lubricant additive product of reaction prepared by reacting a hydrocarbyl or hydrocarbyloxy phenol with an alcohol and a boronating agent selected from the group consisting of boric acid, boric oxide, metaborate and an alkyl borate of the formula:

$$(R^2O)yB(OH)z$$

wherein y is 1 to 3, z is 0 to 2, their sum being 3, and $R^2$ is an alkyl group having from 1 to about 6 carbon atoms and wherein the reaction is carried out at temperatures varying from ambient to about 250° C. under pressure varying from ambient or autogenous for a time sufficient to obtain the desired additive product of reaction and wherein the molar ratios of the various reactants vary from equimolar to more than equimolar to less than equimolar.

15. The additive product of reaction in accordance with claim 14 wherein the reactants are dodecylphenol, boric acid and n-butanol.

16. The additive product of reaction in accordance with claim 14 wherein the reactants are dodecylphenol, boric acid and ditetradecyl catechol.

17. The additive product of reaction in accordance with claim 14 wherein the reactants are dodecylphenol, boric acid and ditetradecyl resorcinol.

18. The additive product of reaction in accordance with claim 14 wherein the reactants are dodecylphenol, boric acid and ditetradecyl hydroquinone.

19. A method of preparing an improved lubricant composition comprising adding to said lubricant a minor multifunctional amount of from about 0.001 to about 10 wt. % based on the total weight of the composition of an additive product of reaction as claimed in claim 14.

* * * * *